US005425539A

United States Patent [19]

Steffes

[11] Patent Number: 5,425,539

[45] Date of Patent: Jun. 20, 1995

[54] GOLFER'3 S ELBOW STIFFENER APPARATUS

[76] Inventor: Robert J. Steffes, 3105 Adams St., Two Rivers, Wis. 54241

[21] Appl. No.: 183,863

[22] Filed: Jan. 21, 1994

[51] Int. Cl.[6] ..... A63B 69/36

[52] U.S. Cl. ..... 273/189 A; 273/DIG. 30

[58] Field of Search ..... 128/879, 881; 273/189 A, DIG. 30, 189 R, 187.2

[56] References Cited

U.S. PATENT DOCUMENTS

| | | | |
|---|---|---|---|
| 3,074,723 | 1/1963 | Esty | 273/189 A |
| 3,423,095 | 1/1969 | Cox | 273/189 R |
| 3,658,345 | 4/1972 | Siggson | 273/189 A |
| 3,990,709 | 11/1976 | De Rogatis | 273/189 A |
| 4,057,255 | 11/1977 | Bishop | 273/189 R |
| 4,436,088 | 3/1984 | Finnieston | 602/20 |
| 4,504,054 | 3/1985 | Jackson et al. | 273/189 A X |
| 5,069,457 | 12/1991 | Korzenowski | 273/189 R |

*Primary Examiner*—George J. Marlo

[57] ABSTRACT

A new and improved golfer's elbow stiffener apparatus includes a stiff continuous tubular assembly which is supported by and which encompasses a user's elbow, an upper portion of a user's arm adjacent to and above the elbow, and a lower portion of the user's arm adjacent to and below the elbow. The continuous tubular assembly includes a first side edge and a second side edge. A flaccid closure assembly is connected to the continuous tubular assembly and is adapted to secure the continuous tubular assembly to the user's elbow and adjacent arm portions. The continuous tubular assembly may be made from substantially inflexible material. Alternatively, the stiff continuous tubular assembly is capable of being flexed outward and inward longitudinally for placement around the user's elbow and adjacent arm portions. An inner liner assembly may be attached to an interior surface of the continuous tubular assembly. The inner liner assembly is made from a cloth material. The flaccid closure assembly includes a first flaccid portion connected to the first side edge of the continuous tubular assembly and extending distally therefrom. A second flaccid portion which is continuous with the first flacid portion is connected to the second side edge of the continuous tubular assembly and extends distally therefrom. A first hook-and-loop connector is connected to the first flaccid portion, and a complementary second hook-and-loop connector is connected to the second flaccid portion. A transverse cross-section of the continuous tubular assembly extends greater than 180 angular degrees.

3 Claims, 3 Drawing Sheets

GOLFER'3 S ELBOW STIFFENER APPARATUS

BACKGROUND OF THE INVENTION

1. Field of the Invention

The present invention relates generally to devices for improving a golfer's swing and, more particularly, to a device for stiffening a golfer's elbow for improving the swing.

2. Description of the Prior Art

In performing certain swings at a golf ball, it is desirable that the golfer maintain the upper arm and the forearm in a straight line. That is, during the swing, the upper arm and the forearm should not bend at the elbow. Maintenance of the straight line between the upper arm and the forearm during the swing helps prevent the golfer from hooking or slicing the ball.

Throughout the years, a number of innovations have been developed relating to devices for preventing certain joints of a golfer's arm from bending during a swing, and the following U.S. patents are representative of some of those innovations: U.S. Pat. Nos. 3,423,095; 3,990,709; 4,057,255; 4,504,054; and 5,069,457.

More specifically, U.S. Pat. No. 3,423,095 discloses a golfing aid that prevents the backward bending of the golfer's hand around the golfer's wrist. Although stiffening a golfer's wrist may be helpful in improving a golfer's swing, maintenance of a still elbow is deemed to be more important.

U.S. Pat. No. 3,990,709 discloses a golfer's elbow stiffener that includes a fabric material having a series of pockets containing stiffening strips and a cover detachably fastened over the pockets and stiffening strips. The fabric material and the stiffening strips are adapted to encircle a golfer's elbow for bracing the elbow on all sides to keep it straight when swinging. The stiffening strips are easily removed from the pockets upon detaching the cover so that the fabric material may be cleaned. One disadvantage in using the device in this patent is that a plurality of individual stiffening strips must be handled and placed in pockets one at a time. Such is a time-consuming and undesirable task. In this respect, it would be desirable if an elbow stiffener device were provided which does not include a plurality of stiffening strips and a plurality of pockets for receiving stiffening strips. Another disadvantage in using the device in this patent resides in the fact that adjacent stiffening strips are not rigidly connected to each other. In essence, the stiffening strips have articulated connections between adjacent sides. Such articulated connections do not provide a continuous stiff region that substantially continuously encircles an elbow. In this respect, it would be desirable if an elbow stiffener device provided a continuously stiff region that substantially encircles an elbow.

U.S. Pat. No. 4,057,255 discloses a golf swing aid that is in the form of a glove and is designed to stiffen the golfer's wrist. No elbow-stiffening capabilities are provided.

U.S. Pat. No. 4,504,054 discloses an elbow brace for golfers that includes a pliable member to be wrapped around a golfer's elbow and an elongated reinforcing member removably housed in an open-ended casing with the pliable member. The reinforcing member is padded on one side and is designed to extend longitudinally along the back of the elbow. The reinforcing member is substantially long and thin. A disadvantage of this device is that the long and thin reinforcing member extends only longitudinally along the back of the elbow. To provide adequate protection to a golfer's elbow, as mentioned above, it would be desirable for a reinforcing device that protects the elbow to substantially encompass all sides of the golfer's elbow. In this respect, it would be desirable if an elbow stiffener device were provided that included a stiff member that is wide enough to substantially wrap around the golfer's elbow.

U.S. Pat. No. 5,069,457 discloses an elbow support used as an instruction aid for a golfer. The device includes a flexible sleeve and a tensioning strip attached to and depending from the sleeve. The width of the tensioning strip is substantially the same as the length of the sleeve. Tension is developed and maintained by having the flexible sleeve wrapped a number of successive times tightly around the elbow. Tension is relieved by loosening the flexible sleeve. A disadvantage of this patented device is that in order to maintain tension on the elbow, the flexible sleeve must be wrapped a number of successive times tightly around the elbow. Such a tense wrapping can cut off blood flow and cause considerable discomfort. In this respect, it would be desirable if an elbow stiffener device were provided which does not wrap an elbow a number of successive times tightly with a flexible material.

Thus, while the foregoing body of prior art indicates it to be well known to use elbow stiffeners for golfers, the prior art described above does not teach or suggest a golfer's elbow stiffener apparatus which has the following combination of desirable features: (1) provides that the upper arm and the forearm do not bend at the elbow; (2) does not include a plurality of stiffening strips and a plurality of pockets for receiving stiffening strips; (3) provides a continuously stiff region that substantially encircles an elbow; (4) includes a stiff member that is wide enough to substantially wrap around the golfer's elbow; and (5) does not wrap an elbow a number of successive times tightly with a flexible material. The foregoing desired characteristics are provided by the unique golfer's elbow stiffener apparatus of the present invention as will be made apparent from the following description thereof. Other advantages of the present invention over the prior art also will be rendered evident.

SUMMARY OF THE INVENTION

To achieve the foregoing and other advantages, the present invention, briefly described, provides a new and improved golfer's elbow stiffener apparatus which includes a stiff continuous tubular assembly which is supported by and which encompasses a user's elbow, an upper portion of a user's arm adjacent to and above the elbow, and a lower portion of the user's arm adjacent to and below the elbow. The continuous tubular assembly includes a first side edge and a second side edge. A flaccid closure assembly is connected to the continuous tubular assembly and is adapted to secure the continuous tubular assembly to the user's elbow and adjacent arm portions.

The continuous tubular assembly may be made from substantially inflexible material. The stiff continuous tubular assembly is capable of being flexed outward longitudinally such that the first side edge and the second side edge can be moved apart from each other such that the continuous tubular assembly can be placed around the user's elbow and adjacent arm portions.

Also, the continuous tubular assembly is capable of being flexed inward longitudinally such that the first side edge and the second side edge can be moved toward each other after the continuous tubular assembly has been placed around the user's elbow and adjacent arm portions.

An inner liner assembly may be attached to an interior surface of the continuous tubular assembly. The inner liner assembly is made from a cloth material.

The flaccid closure assembly includes a first flaccid portion connected to the first side edge of the continuous tubular assembly and extending distally therefrom. A second flaccid portion is connected to the second side edge of the continuous tubular assembly and extends distally therefrom.

A first connector assembly is connected to the first flaccid portion, and a second connector assembly is connected to the second flaccid portion. The first connector assembly includes a first hook-and-loop connector, and the second connector assembly includes a second hook-and-loop connector. The first hook-and-loop connector and the second hook-and-loop connector are complementary.

A transverse cross-section of the continuous tubular assembly extends greater than one hundred eighty angular degrees; and, as a result, the first side edge and the second side edge of the continuous tubular assembly are separated from each other by less than one hundred eighty angular degrees when the continuous tubular assembly is supported by the user's elbow and adjacent arm portions.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will be for the subject matter of the claims appended hereto.

In this respect, before explaining a preferred embodiment of the invention in detail, it is understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

Further, the purpose of the foregoing Abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. Accordingly, the Abstract is neither intended to define the invention or the application, which only is measured by the claims, nor is it intended to be limiting as to the scope of the invention in any way.

It is therefore an object of the present invention to provide a new and improved golfer's elbow stiffener apparatus which has all of the advantages of the prior art and none of the disadvantages.

It is another object of the present invention to provide a new and improved golfer's elbow stiffener apparatus which may be easily and efficiently manufactured and marketed.

It is a further object of the present invention to provide a new and improved golfer's elbow stiffener apparatus which is of durable and reliable construction.

An even further object of the present invention is to provide a new and improved golfer's elbow stiffener apparatus which is susceptible of a low cost of manufacture with regard to both materials and labor, and which accordingly is then susceptible of low prices of sale to the consuming public, thereby making such golfer's elbow stiffener apparatus available to the buying public.

Still yet a further object of the present invention is to provide a new and improved golfer's elbow stiffener apparatus which provides that the upper arm and the forearm do not bend at the elbow.

Still another object of the present invention is to provide a new and improved golfer's elbow stiffener apparatus that does not include a plurality of stiffening strips and a plurality of pockets for receiving stiffening strips.

Yet another object of the present invention is to provide a new and improved golfer's elbow stiffener apparatus which provides a continuously stiff region that substantially encircles an elbow.

Even another object of the present invention is to provide a new and improved golfer's elbow stiffener apparatus that includes a stiff member that is wide enough to substantially wrap around the golfer's elbow.

Still a further object of the present invention is to provide a new and improved golfer's elbow stiffener apparatus which does not wrap an elbow a number of successive times tightly with a flexible material.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawing wherein.

DESCRIPTION OF THE PREFERRED EMBODIMENT

With reference to the drawings, a new and improved golfer's elbow stiffener apparatus embodying the principles and concepts of the present invention will be described.

Figure 1:
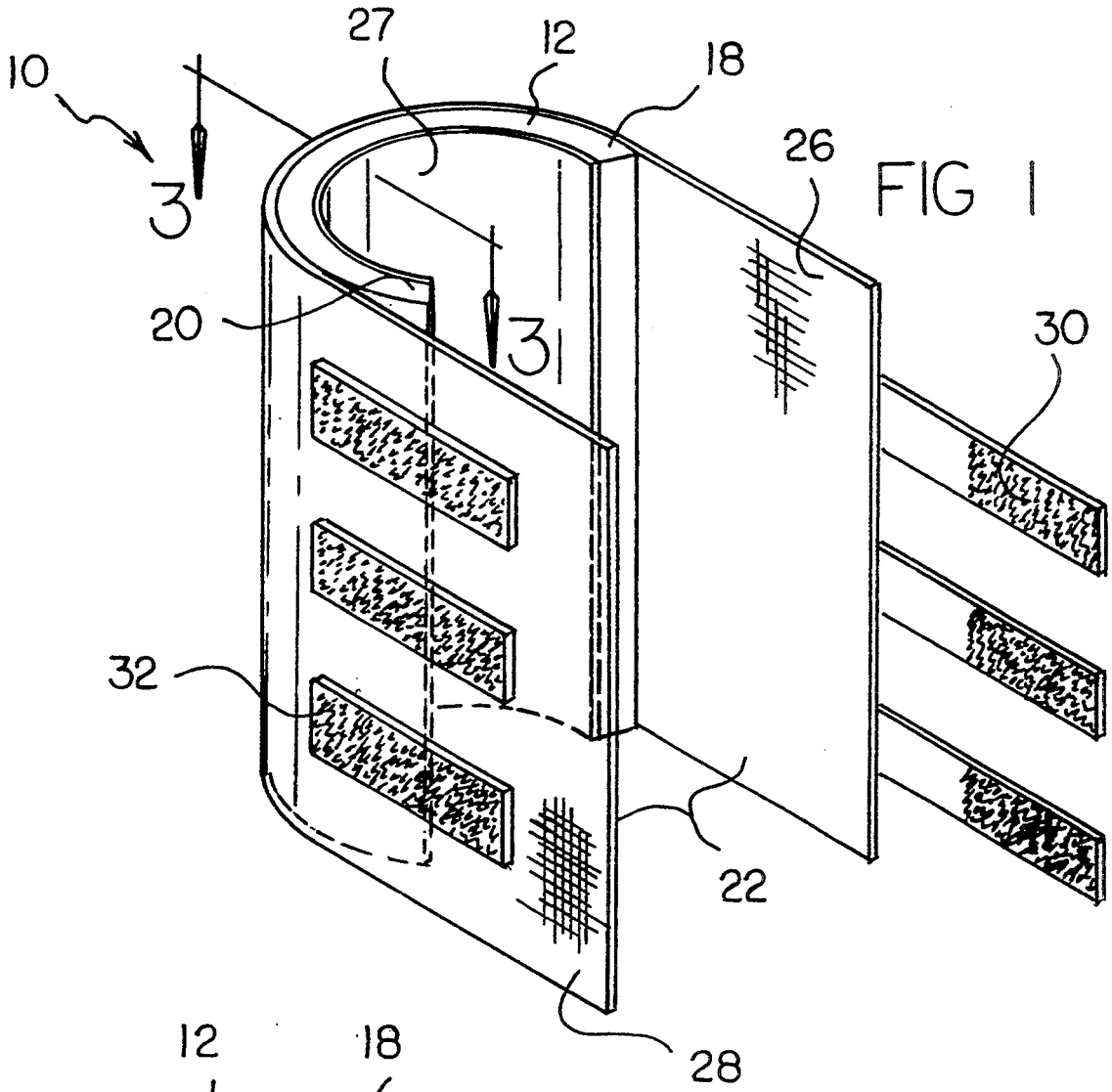
FIG. 1 is a perspective view showing a preferred embodiment of the golfer's elbow stiffener apparatus of the invention.
Figure 2:
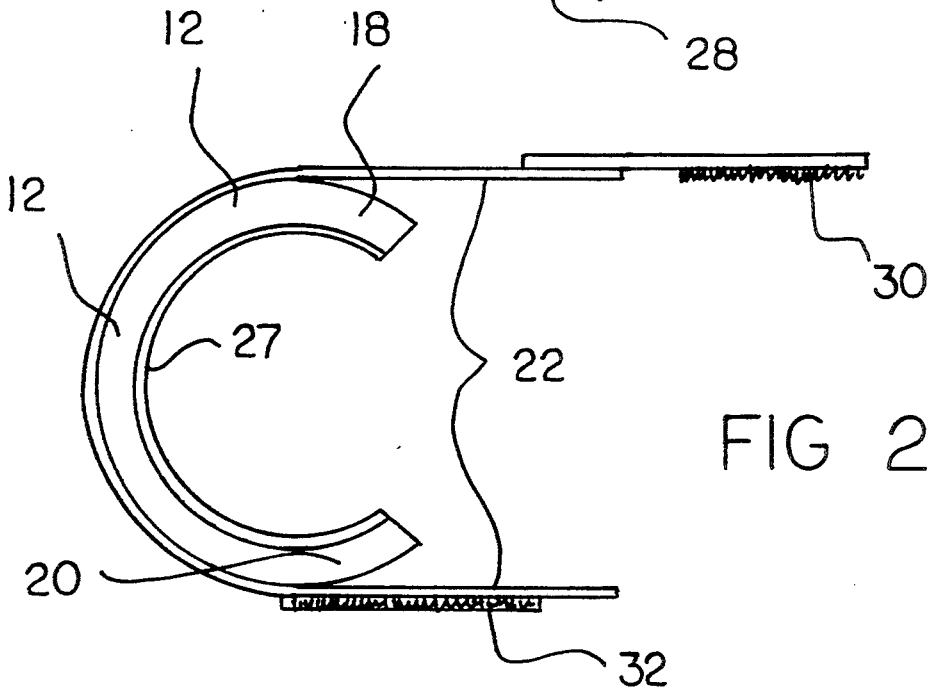
FIG. 2 is a top view of the embodiment of the golfer's elbow stiffener apparatus shown in FIG. 1.
Figure 3:
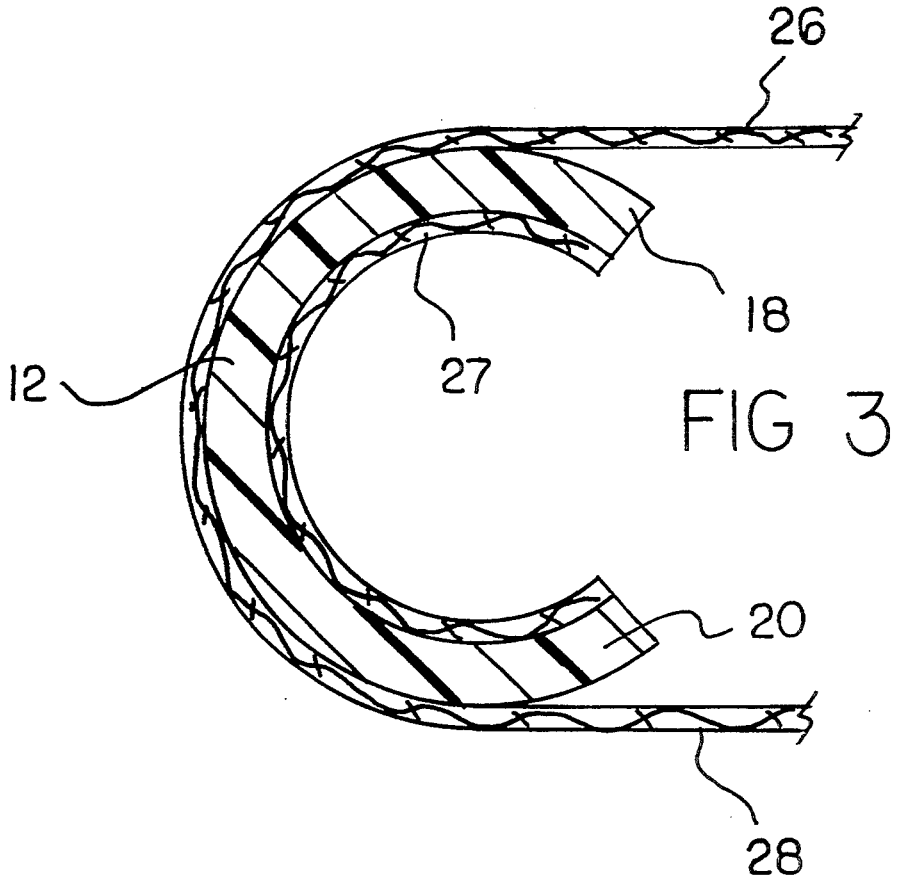
FIG. 3 is a cross-sectional view of the embodiment of the golfer's elbow stiffener apparatus of FIG. 1 taken along line 3—3 thereof.
Figure 4:
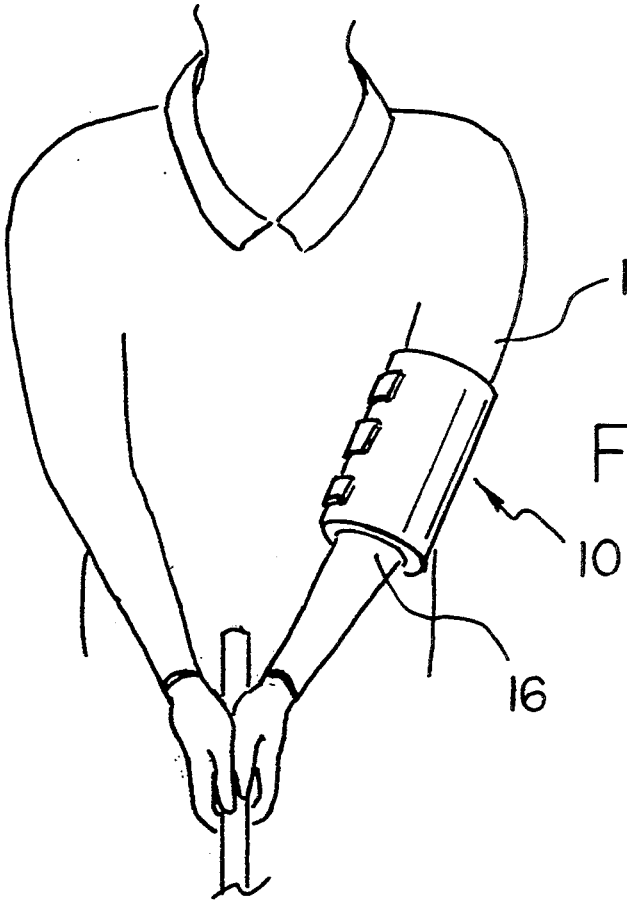
FIG. 4 is a perspective view of a the embodiment of the invention shown in FIG. 1 being worn on the left elbow of a golfer.
Figure 5:
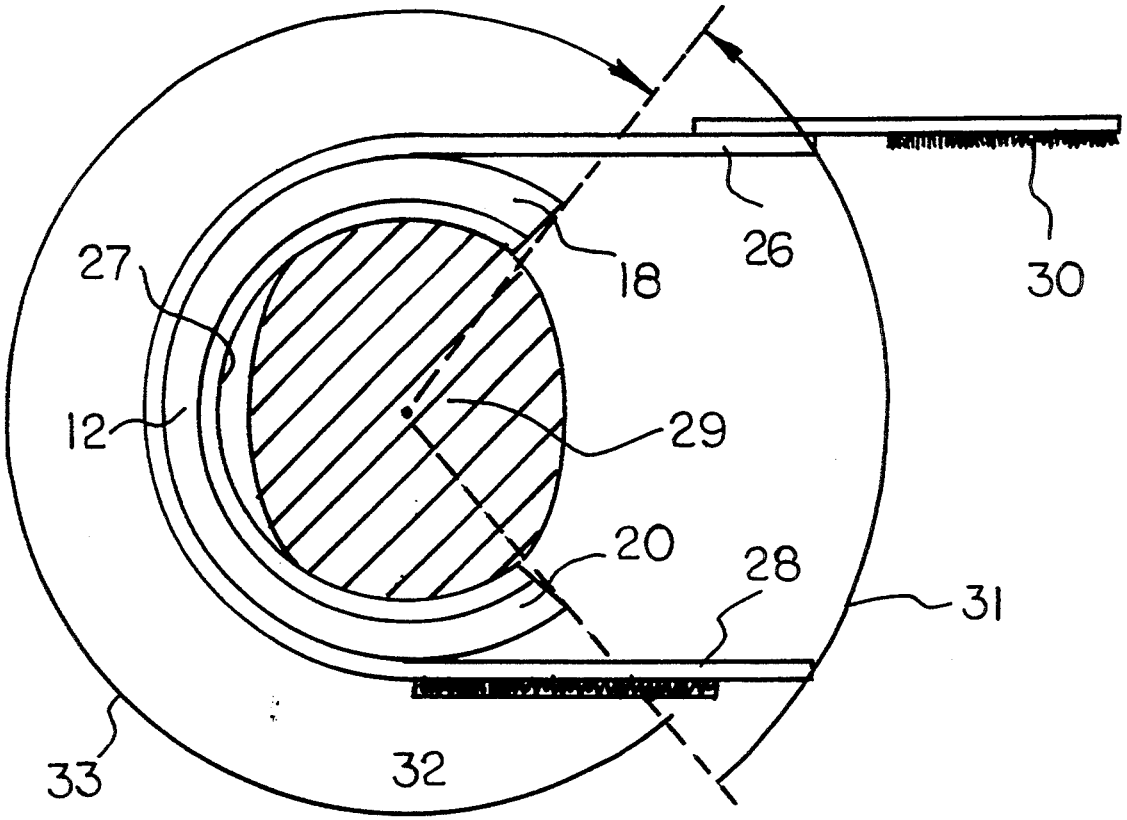
FIG. 5 is a transverse cross-sectional view of an embodiment of the invention in use around an elbow.

Turning initially to FIGS. 1–5, there is shown an exemplary embodiment of the golfer's elbow stiffener apparatus of the invention generally designated by reference numeral 10. In its preferred form, golfer's elbow stiffener apparatus 10 includes a stiff continuous tubular assembly 12 which is supported by and which encompasses a user's elbow, an upper portion 14 of a user's arm adjacent to and above the elbow, and a lower portion 16 of the user's arm adjacent to and below the elbow. The continuous tubular assembly 12 includes a first side edge 18 and a second side edge 20. A flaccid closure assembly 22 is connected to the continuous tubular assembly 12 and is adapted to secure the continuous tubular assembly 12 to the user's elbow and adjacent arm portions. The apparatus off of a user is shown in FIGS. 1–3. A user is shown in FIG. 4. The apparatus on a user is shown in FIGS. 4 and 5.

The continuous tubular assembly 12 may be made from substantially inflexible material. Alternatively and preferably, the stiff continuous tubular assembly 12 is capable of being flexed outward longitudinally such that the first side edge 18 and the second side edge 20 can be moved apart from each other such that the continuous tubular assembly 12 can be placed around the user's elbow and adjacent arm portions. Also, the continuous tubular assembly 12 is capable of being flexed inward longitudinally such that the first side edge 18 and the second side edge 20 can be moved toward each other after the continuous tubular assembly 12 has been placed around the user's elbow and adjacent arm portions.

An inner liner assembly 27 is attached to an interior surface of the continuous tubular assembly 12. The inner liner assembly 27 is made from a cloth material.

The flaccid closure assembly 22 includes a first flaccid portion 26 connected to the first side edge 18 of the continuous tubular assembly 12 and extending distally therefrom. A second flaccid portion 28 is connected to the second side edge 20 of the continuous tubular assembly 12 and extends distally therefrom. As shown in the figures, the first flaccid portion 26 and the second flaccid portion 28 are formed as a unified, integrated structure that wraps around the full exterior surface of the continuous tubular assembly 12.

A first connector assembly 30 is connected to the first flaccid portion 26, and a second connector assembly 32 is connected to the second flaccid portion 28. The first connector assembly 30 includes a first hook-and-loop connector material, and the second connector assembly 32 includes a second hook-and-loop connector material. The first hook-and-loop connector material and the second hook-and-loop connector material are complementary. More specifically, the first hook-and-loop connector material and the second hook-and-loop connector material can be complementary VELCRO(TM) fasteners.

Generally, in accordance with the invention, a transverse cross-section of the continuous tubular assembly 12 extends greater than 180 angular degrees.

As shown in FIG. 5, the first side edge 18 and the second side edge 20 of the continuous tubular assembly 12 are adapted to be separated from each other by first angle 31 which is less than 180 degrees when the continuous tubular assembly 12 is supported by the user's elbow 29 and adjacent arm portions. In this respect, in FIG. 5, the transverse cross-section of the continuous tubular assembly 12 extends a second angle 33 which is greater than 180 angular degrees. More specifically, first angle 31 is approximately 90 angular degrees; and second angle 33 is approximately 270 angular degrees, In FIG. 5, a transverse cross-section of the continuous tubular assembly 12 is in the form of the letter "C". More specifically, a transverse cross-section of the continuous tubular assembly 12 is such that it is greater than a semicircle. Strictly speaking, a semicircle covers 180 angular degrees. However, in accordance with the principles of the invention, a transverse cross-section of the continuous tubular assembly 12 covers more than 180 angular degrees.

The continuous tubular assembly 12 can be made from any suitable material that is stiff or semi-rigid. That is, the material is rigid enough to serve well as an elbow brace and is flexible enough in a longitudinal direction to be flexed longitudinally to be applied to and removed from the user's elbow and adjacent arm portions. One suitable material for the continuous tubular assembly 12 is medium polyurethane. The flaccid closure assembly 22 can be made from a flaccid fabric or a vinyl plastic.

The components of the golfer's elbow stiffener apparatus of the invention can be made from inexpensive and durable metal and plastic materials.

As to the manner of usage and operation of the instant invention, the same is apparent from the above disclosure, and accordingly, no further discussion relative to the manner of usage and operation need be provided.

It is apparent from the above that the present invention accomplishes all of the objects set forth by providing a new and improved golfer's elbow stiffener apparatus that is low in cost, relatively simple in design and operation, and which may advantageously be used to provide that the upper arm and the forearm do not bend at the elbow. With the invention, a golfer's elbow stiffener apparatus is provided which does not include a plurality of stiffening strips and a plurality of pockets for receiving stiffening strips. With the invention, a golfer's elbow stiffener apparatus is provided which provides a continuously stiff region that substantially encircles an elbow. With the invention, a golfer's elbow stiffener apparatus is provided which includes a stiff member that is wide enough to substantially wrap around the golfer's elbow. With the invention, a golfer's elbow stiffener apparatus is provided which does not wrap an elbow a number of successive times tightly with a flexible material.

With respect to the above description, it should be realized that the optimum dimensional relationships for the parts of the invention, to include variations in size, form function and manner of operation, assembly and use, are deemed readily apparent and obvious to those skilled in the art, and therefore, all relationships equivalent to those illustrated in the drawings and described in the specification are intended to be encompassed only by the scope of appended claims.

While the present invention has been shown in the drawings and fully described above with particularity and detail in connection with what is presently deemed to be the most practical and preferred embodiments of the invention, it will be apparent to those of ordinary skill in the art that many modifications thereof may be made without departing from the principles and concepts set forth herein. Hence, the proper scope of the present invention should be determined only by the broadest interpretation of the appended claims so as to encompass all such modifications and equivalents.

What is claimed as being new and desired to be protected by Letters Patent of the United States is as follows:

1. A new and improved golfer's elbow stiffener apparatus, comprising:

a stiff continuous tubular assembly adapted to be supported by and encompass a user's elbow, an upper portion of a user's arm adjacent to and above the elbow, and a lower portion of the user's arm adjacent to and below the elbow, said continuous tubular assembly including a first side edge and a second side edge, a flaccid closure assembly, connected to said continuous tubular assembly, adapted to secure said continuous tubular assembly to the user's elbow and adjacent arm portions, and an inner liner assembly, made from a cloth material, attached to an interior surface of said continuous tubular assembly, wherein said flaccid closure assembly includes a first flaccid portion connected to said first side edge of said continuous tubular assembly and extending distally therefrom, a second flaccid portion connected to said second side edge of said continuous tubular assembly and extending distally therefrom, said first flaccid portion and said second flaccid portion connected together to form a continuous flaccid portion that fully encompasses a portion of said outer surface of said continuous tubular assembly including said first side edge and said second side edge, and wherein said flaccid closure assembly further includes a first connector assembly, including a first hook-and-loop connector, connected to said first flaccid portion, and a second connector assembly, including a second hook-and-loop connector, connected to said second flaccid portion.

2. The apparatus described in claim 1 wherein said continuous tubular assembly is made from substantially inflexible material.

3. The apparatus described in claim 1 wherein a transverse cross-section of said continuous tubular assembly extends greater than 180 angular degrees.

* * * * *